United States Patent [19]

Seaton

[11] 4,196,829

[45] Apr. 8, 1980

[54] STOPPER THROTTLING SYSTEM

[75] Inventor: William W. Seaton, Dexter, Mich.

[73] Assignee: Seaton Engineering Company, Ann Arbor, Mich.

[21] Appl. No.: 922,871

[22] Filed: Jul. 7, 1978

[51] Int. Cl.[2] ..... B22D 41/10

[52] U.S. Cl. ..... 222/602; 74/834; 222/509; 251/60; 251/285

[58] Field of Search ..... 74/110, 522, 522.5, 74/828, 834; 251/60, 78, 285; 222/309, 602, 509, 559

[56] References Cited

U.S. PATENT DOCUMENTS

| | | | |
|---|---|---|---|
| 2,266,081 | 12/1941 | Rogers | 222/602 X |
| 3,762,605 | 10/1973 | Seaton | 222/602 |

*Primary Examiner*—David A. Scherbel
*Attorney, Agent, or Firm*—Robert L. Olson

[57] ABSTRACT

A stopper valve actuating mechanism for a bottom pour casting container including an adjustable limit motion connection within the lever train which allows for a finer control of the pour of the molten metal. The adjustable limit stop connection comprises a piston and cylinder arrangement.

3 Claims, 3 Drawing Figures

STOPPER THROTTLING SYSTEM

BACKGROUND OF THE INVENTION

In the molten metal casting field, accurate control of the opening and closing of the stopper valve in a bottom pour casting container is essential. The control has to be such that liquid metal can be fed into a mold in accurately measured quantities, and at different rates of pour during the pouring cycle. Generally, it is desirable to pour at a fast rate initially, and then gradually slow the pouring rate near the end of a pour. A typical stopper valve actuating mechanism in present day use is shown and described in my U.S. Pat. No. 3,762,605, entitled "Control Device for Stopper of a Casting Container," which issued on Oct. 2, 1973. The present application is an improvement over the mechanism shown in that patent.

SUMMARY OF THE INVENTION

The stopper valve actuating mechanism of the invention includes an adjustable limit motion connection in a lever train, in the form of a piston and cylinder arrangement. The stopper valve is initially opened by admitting pressure via air or fluid to the cylinder, causing the piston to bottom out. This forms a direct mechanical connection between a throttle control drive assembly and the lever train, so that extremely fine control of the pouring cycle is possible.

DESCRIPTION OF THE PREFERRED EMBODIMENT

Figure 1:
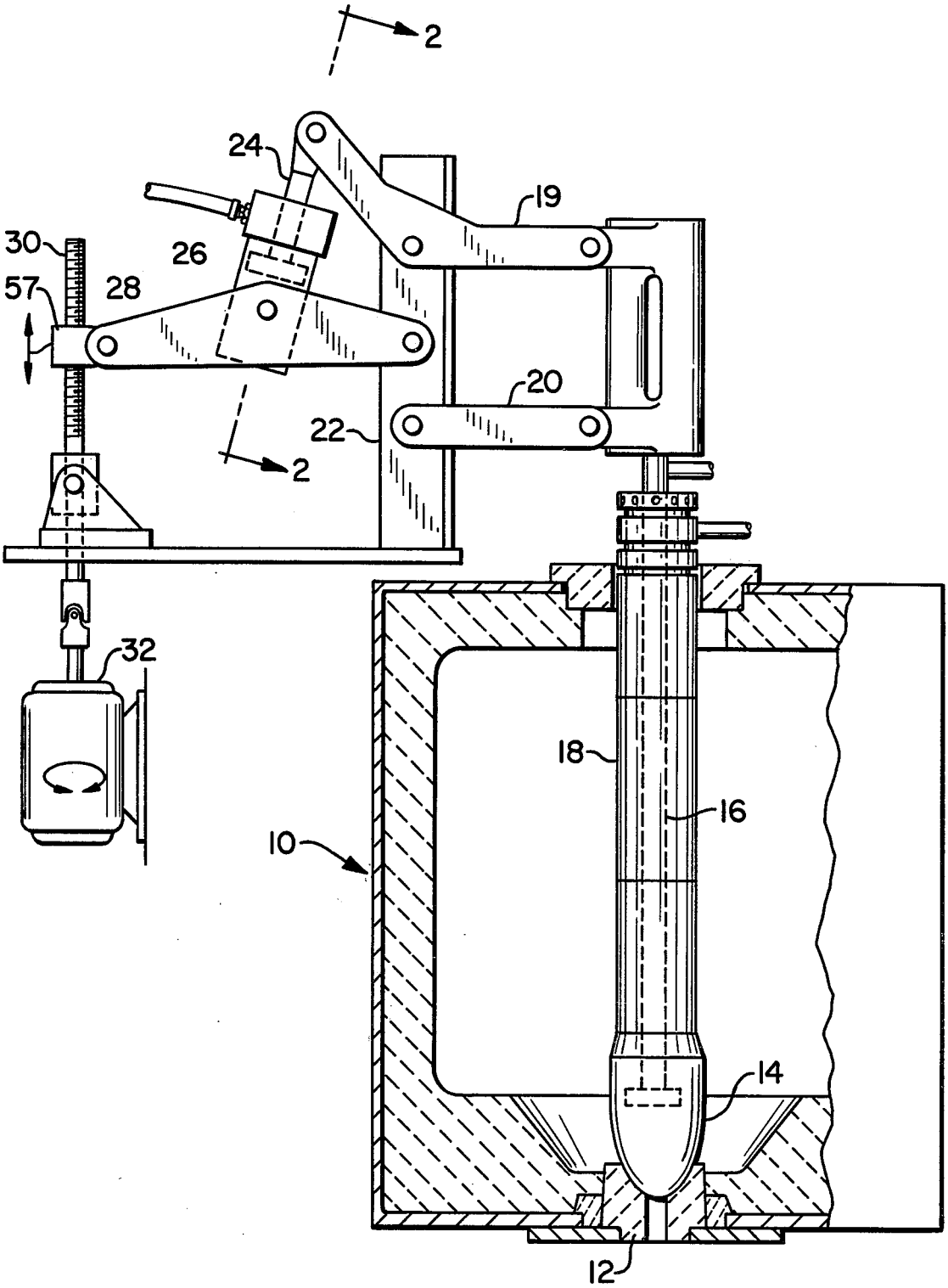
FIG. 1 is an elevational view, partly in section, of a bottom pouring ladle.

Looking now to FIG. 1, numeral 10 designates a refractory lined pouring ladle, from which molten metal can be poured. The ladle has a bottom outlet nozzle 12, and a stopper valve 14, for controlling flow of metal from the ladle. The stopper valve is mounted on the end of a stopper rod 16. This rod is surrounded by refractory sleeves 18 to protect it from the molten metal within the ladle 10. An alternate stopper rod of one or more refractory parts can be attached to the stopper valve.

Secured to the upper end of rod 16 is an upper dogleg lever 19, and a lower lever 20. Both levers are pivotally connected to stationary vertical post 22, and together with the upper end of rod 16 they form a parallelogram. The opposite end of dogleg lever 19 is attached to the end of a piston rod 24. The piston cooperates with a cylinder 26 which is pivotally secured to a lever 28. Lever 28 is pivotally connected at its ends to stationary post 22, and a rod 30. Rod 30 is threaded and attached to and rotatably driven by the throttle control drive assembly 32, via a threaded nut 57.

Figure 2:
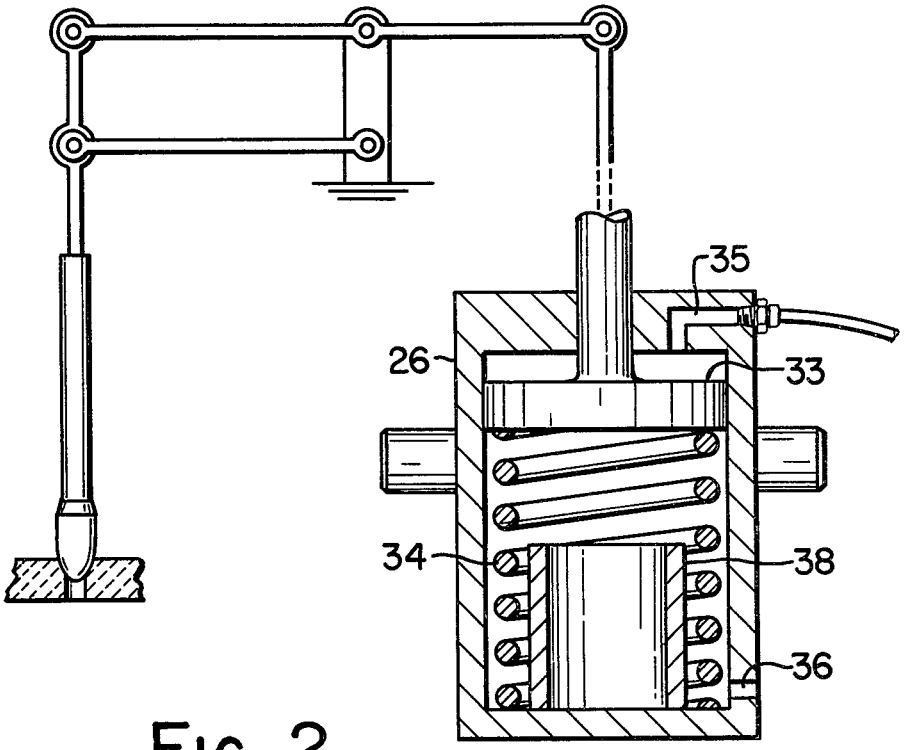
FIG. 2 is an enlarged sectional view of the piston-cylinder arrangement of the stopper valve actuating mechanism.

Looking now to FIG. 2, the piston-cylinder arrangement is shown in more detail. As can be seen the piston 33 is biased to its uppermost position by a spring 34. Pressurized air (60–90 psi) can be admitted above the piston through port 35. The other side of the piston is open to the atmosphere through port 36. When the piston is actuated by pressurized air, it seats in its bottom-most position on seat or stop member 38. When the piston is in its bottom-most position, there is a direct mechanical connection between the throttle control drive assembly 32 and the valve 14 (FIG. 1).

Figure 3:
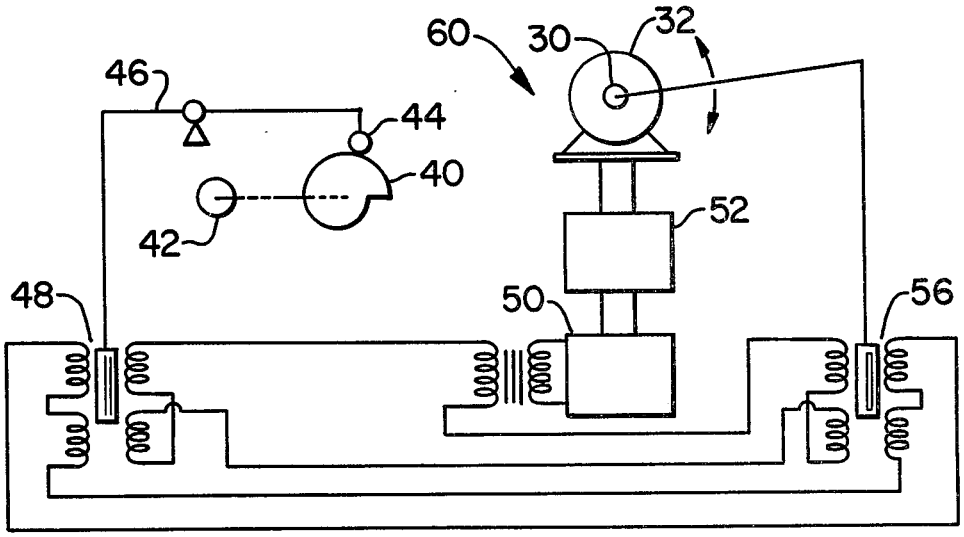
FIG. 3 is a schematic of an example of a throttling control drive for the stopper valve.

Looking now to FIG. 3, the throttle control drive assembly 32 is shown. This is the structure which determines one of several manners in which a programmed pouring cycle is carried out. The function of the shown electrical control circuit is based on a so-called zero balance. A rotatable programming cam 40 whose profile determines in response to the angle of rotation the reference input for the adjustment of the rod 30, is angularly displaced according to a predetermined time sequence by means of a servo motor 42. A cam follower 44 follows the periphery of the cam 40 and displaces via a lever 46 according to the resulting command variable, an originator of signal 48 such as, for example, an inductive sender or a servo motor. The generated signal is amplified in an amplifier 50 and fed into a converter 52 where it is converted into a proportional amount of drive pulse which drives a stepping motor 32 in one direction, the output shaft of which motor is rod 30. It also displaces a counterbalancing signal originator 56 to a balanced position. The signal generated by the signal originator 56 is connected to the signal originator 48 for counteracting the output signal of the latter after the pouring cycle, to reset the control device in its original position, ready for another pour.

In this manner, the control cam determines the program for controlling the actuation of rod 30, and ultimately, the displacement of the valve 14. It is, of course, possible to replace the above described electromechanical throttle control drive assembly with a control arrangement operating on a different principle, such as a hydraulic, pneumatic, or digital motor.

The operation of the above will now be described. When it is desired to make a pour, pressurized air is admitted above the piston 33 to seat it in its bottom-most position on seat 38. This initially opens the valve 14, and forms a direct mechanical connection between the throttle control drive assembly 32 and the valve 14. The throttle control drive assembly 32 is then actuated, and by moving the cylinder 26, thereafter controls movement of the lever train to determine the rate of closing of the valve, and thus the timing and rate of the pour throughout the pouring cycle. After the pour, the pressurized air to the piston 33 is discontinued, allowing the piston to move to its uppermost position by action of the spring 34, and the throttle control drive assembly 32 resets itself. The direct mechanical connection during the pouring cycle permits very fine control, without the need of any complex, expensive motor control in the throttle control drive assembly.

What is claimed is:

1. Apparatus for controlling the discharge of molten metal through a bottom opening of a pouring ladle comprising a valve head, a stopper rod for actuating the valve head, a first lever, said first lever being connected to the stopper rod, a second lever, said second lever being connected to the first lever by means of an adjustable limit connection, which permits movement of the first lever in such a manner to cause full opening of the valve head without movement of the second lever, and also forming a direct mechanical connection between said first and second levers, so that thereafter movement of the second lever causes corresponding movement of the valve head.

2. The apparatus set forth in claim 1, wherein the adjustable limit stop connection is a piston and cylinder.

3. The apparatus set forth in claim 2, including a spring biasing the piston to a first position within the cylinder, which first position permits movement of the first lever relative to the second lever, a source of pressurized air or fluid, means for allowing the pressurized air or fluid to overcome the force of the spring, moving the piston to a second position within the cylinder, which second position forms a direct mechanical connection between said first and second levers, so that movement of the second lever causes movement of the first lever.

* * * * *